United States Patent [19]

Poe et al.

[11] 4,347,929

[45] Sep. 7, 1982

[54] BLASTING CAP CONTAINER

[75] Inventors: Barber S. W. Poe, Piney Point; Lennard J. Wolfson, LaPlata, both of Md.

[73] Assignee: The United States of America as represented by the Secretary of the Navy, Washington, D.C.

[21] Appl. No.: 160,051

[22] Filed: Jun. 16, 1980

[51] Int. Cl.[3] ..... F42B 37/00; F42B 39/00

[52] U.S. Cl. ..... 206/3; 206/523

[58] Field of Search ..... 206/3, 523, 315 B, 524.8; 220/303, 288

[56] References Cited

U.S. PATENT DOCUMENTS 1,911,125 5/1933 Miller ..... 206/315 B

FOREIGN PATENT DOCUMENTS 1260646 4/1961 France ..... 206/523

199429 6/1923 United Kingdom ..... 206/3

*Primary Examiner*—William T. Dixson, Jr.

*Attorney, Agent, or Firm*—R. F. Beers; K. E. Walden; J. C. Laprade

[57] ABSTRACT

A blasting cap container consisting of a cylindrical vessel with one permanently closed end and one end fitted with a threaded door, wherein the caps are secured within the vessel in a manor to totally contain any detonation effects.

9 Claims, 9 Drawing Figures

BLASTING CAP CONTAINER

FIELD OF THE INVENTION

The invention relates to a blasting cap container and more particularly to a container that will allow shipment and storage of a number of blasting caps wherein the container is capable of absorbing and totally containing the blast. The container is sufficiently strong and secure to allow the simultaneous blast of a number of blasting caps without allowing shock or other products of the blast to affect primary explosives in the area.

BACKGROUND OF THE INVENTION

Because of the increasing need for weapons systems security and for safeguarding individual weapons systems components particularly to protect the same from explosion, for example, artillery projectiles, high explosive devices containing TNT and dynamite as well as nuclear warheads and other explosive devices, there exists at present a demand for shipping and storage containers capable of containing a relatively small explosion without affecting other warheads or explosive devices in the area. Therefore there is considerable need for a container for blasting caps that is capable of containing an explosion of the caps held therein and so that there is no detonation or shock or other appreciable effect on any primary explosive in the same vehicle or in the immediate area.

Shipping and storage containers for blasting caps and contemplated for shipment with other primary explosives must be capable of being handled by military or other authorized personnel without extreme difficulty. These storage containers should always be capable of being shipped by rail, truck plane, ship or the like with reasonable dispatch. At the same time, it may be desirable for the containers to be of sufficient size, bulk, and weight such that the container can be packed and shipped with other explosive containers.

The blasting cap container should be sufficiently strong and sturdy so that it will completely contain any explosion therein without detonating any surrounding primary explosives in the surrounding area or in the same vehicle with the container.

The instant invention provides a container for the transportation and storage for a number of blasting caps for example: five to ten caps so that such a container can be transported in the same vehicle with primary explosives. This of course necessarily requires total and absolute containment of any explosion or detonation of the caps.

The prior art blasting cap containers for the most part have never attempted nor accomplished total containment of the detonation effects of multiple blasting caps. Where partial containment has been attempted the results have varied and have of times been unsatisfactory. In most instances two vehicles for example: two trucks or two planes have been used for transportation by military units of blasting caps and primary explosives in such cases one vehicle is used for the blasting caps and one for the primary explosives so that if the caps are detonated inadvertently the primary explosive is not detonated simultaneously.

In addition it has been recognized by those skilled in the art, that containers for blasting caps and similar explosives must be sufficiently strong and sturdy to allow the container to be handled by authorized personnel so that in the event of inadvertent detonation personnel will not be injured. In such cases safety of personnel is equally or more important than detonation of any surrounding of any primary explosive in the surrounding area or in the same vehicle.

In addition both the contained explosive device such as blasting caps and any other primary explosives in the immediate area must be protected.

SUMMARY OF THE INVENTION

In accordance with the present invention there is provided a blasting cap shipping and storage container for total containment of the possible detonation of a number of blasting caps stored and transported therein.

In general terms the container provided in accordance with the instant invention comprises a cylindrical container welded closed on one end. The other end is normally closed by a screw on door member that has corresponding heavy buttress threads. The interior of said vessel or container is provided with an insert made of a frangible foam or similar absorptive material having at least ten openings in the insert, each of said openings accommodating one blasting cap or a blasting cap container with wire coil in the case of electronic caps.

One additional feature of the container is a vent means comprising an opening in association with a valve mechanism extending through the wall of the container.

Such a vent mechanism with a screw in valve allows gases produced during detonation or explosion of the caps to escape from the container at a low pressure and low velocity so as not to disturb or shock any adjacent primary explosive in the area or to injure personnel in the area.

One object of the present invention is to allow safe transportation and storage of a plurality of blasting caps in the same vehicle with primary explosives without any danger of detonating the primary explosives.

Still another object of the present invention is to provide a reasonably economical and safe compact storage for explosive devices such as blasting caps.

Yet another object of the present invention is to provide a container sufficiently strong, heavy durable and bulky so that it allows safe movement of blasting caps or similar explosives without risk or danger of injury to personnel moving or carrying transporting such device.

One other advantage of the present invention is that in accordance therewith a container be provided that allows explosive devices to be safely stored and shipped at reasonable costs.

Another advantage of the present invention is that blasting caps can be stored in containers in accordance therewith and can be handled to such an extent that if the container is inadvertently dropped or is struck by a sizeable weight with sufficient force the container device and explosives contained therein will, even if the caps are detonated not transmit explosive force or shock waves and any other detrimental effect to the personnel or primary explosives in the area.

One additional advantage of the instant invention is to provide a blasting cap container in accordance therewith that is provided with a O-ring sealing mechanism so as to better contain the gases produced by any inadvertent explosion of the blasting caps or other explosives contained therein.

BRIEF DESCRIPTION OF THE DRAWINGS

Other objects and advantages of the present invention will be apparent to those skilled in the art from the following disclosure with reference to the appended drawings wherein like numbers denote like parts and wherein.

DETAILED DESCRIPTION OF A PREFERRED EMBODIMENT

Figure 1B:
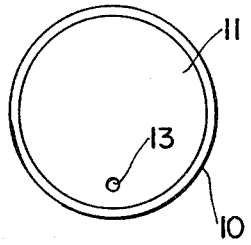
FIG. 1 is a side view and corresponding end view of the container in accordance with the present invention and FIG. 2 is an expanded exploded view of the vent-valve mechanism that allows the low pressure escape of gases formed by inadvertent detonation of the blasting caps.
Figure 1A:
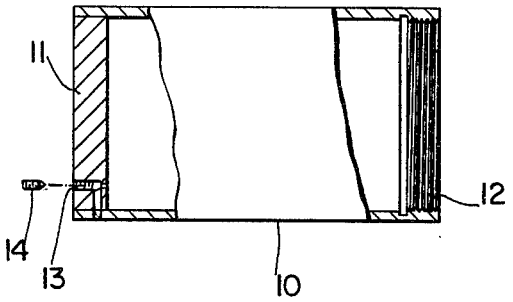

The FIG. 1 illustrates a preferred embodiment of the invention. The invention disclosed is a container for blasting caps comprising a cylindrical vessel 10. The container 10 in one preferred embodiment is made of stainless steel having sidewall thickness of approximately one fourth inch and an outside diameter of 10.2 centimeters and being 30.5 centimeters long. Other dimensions may be used if desired. The base wall of the container is approximately three quarters of an inch thick and is also made of stainless steel. The base wall 11, may in the preferred embodiment consist of stainless steel or other suitable metal and varying thickness from about one and a half inch to three quarters of an inch. The upper end of the container fitted on its interior diameter with square or buttress threads 12 is designed to facilitate the threaded door or end member 21 with handle 22 best shown in FIG. 3.

In FIG. 1 the vent fitted with interior screws is illustrated at 13 with conical screw member 14 shown therein as a means for releasing at low pressure any gases formed by inadvertent explosion or detonation of the caps contained within container or vessel 10.

Figure 2:
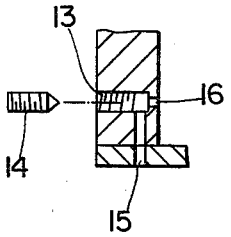

In FIG. 2 an exploded view showing in detail valve member with vent opening 13 with interior screw threads and a small opening 16 communicating with the interior of container 10. In FIG. 2 conical screw member 14 is fitted with exterior threads that communicate with the interior threads in opening 13. In the operation of this vent mechanism, conical screw member 14 is screwed into opening 13 so that the point thereof is lodged in opening 16. When it is desired to release the gases from the interior of container 10, screw member 14 is backed out of opening 13 so that gases may escape through opening 16 that is in communication with and directly connected to opening 15 in the base wall of the container. Opening 15 opens through the side wall of the container and will allow gases to pass through opening 15 in the side wall into the atmosphere at low pressure and velocity. As gases escape through opening or conduct 15 the pressure and velocity of the gases are sufficiently decreased so as to enter the atmosphere at pressures and velocities that are so small as not to effect primary explosives in the area.

Figure 4A:
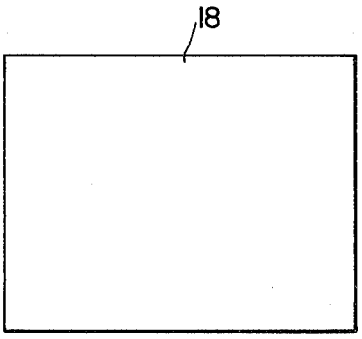
FIG. 4*a* is a side view.
Figure 4B:
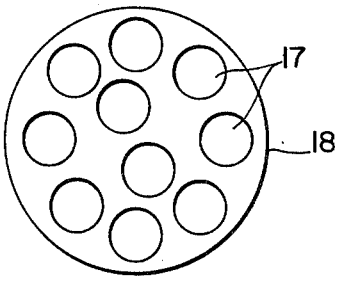
FIG. 4*b* is an end view of the foam or other frangible shock absorbing insert containing ten openings, each opening to accommodate one electronic blasting cap.

In the preferred embodiment of the invention a polyethylene foam insert 18 is illustrated. This foam insert in the preferred embodiment is approximately 4.7 inches in diameter and approximately 5.5 inches long and designed to fit within the container illustrated in FIG. 1. The foam insert 18 is fitted with a number of openings, (10) to be exact in the insert shown in FIG. 4. Each of the openings 17 in insert are designed to accommodate a conventional electronic blasting cap container. Such conventional blasting caps and their paste board or paper containers are approximately three quarters of an inch in diameter. It should be understood that the openings in the foam blasting cap holder 18 may be of any desired size that is prearranged to fit conventional electronic blasting cap containers. The blasting cap containers are usually made of paper or pasteboard so as to accommodate the cap with the electrical leads within the said paper container.

Figure 5A:
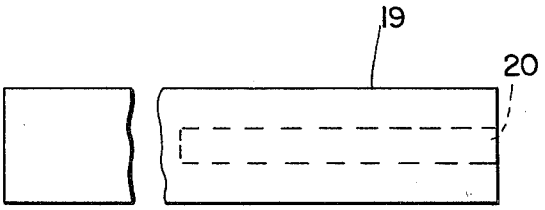
FIG. 5*a* is a side view.
Figure 5B:
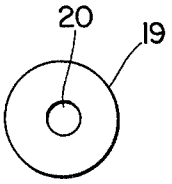
FIG. 5*b* is an end view of a small insert container for conventional nonelectric blasting caps each said insert fitting within one of the ten (10) openings shown in FIG. 4*b*.

In the preferred embodiment shown in FIG. 5 a insert for a conventional non-electronic blasting cap made of a soft, pliable, shock absorbing material such as polyethylene foam or soft wood such as pine or balsa wood approximately 5.25 inches long and 0.7 inches in diameter having an opening therein to accommodate a conventional non-electronic blasting cap is illustrated. The opening within the foam plastic or other shock absorbing material is approximately 0.25 inches in diameter and of sufficient size both in width and length to fully accommodate a conventional non-electronic blasting cap.

The insert illustrated FIG. 5 having an opening 20 therein is in the preferred embodiment made of foam polyethylene or some other foam material. In a preferred embodiment the insert 19 is approximately 5.25 to 5.5 inches in length and will fit within the openings 17 shown in FIG. 4. In addition the insert 19 as illustrated in FIG. 5 may be advantageously made of other soft, pliable or other suitable shock absorbing materials. The opening 20 in the insert shown in FIG. 5 usually will be in the range of 0.2 to 0.3 inches and of sufficient size to accommodate a conventional non-electronic blasting cap.

Figure 3:
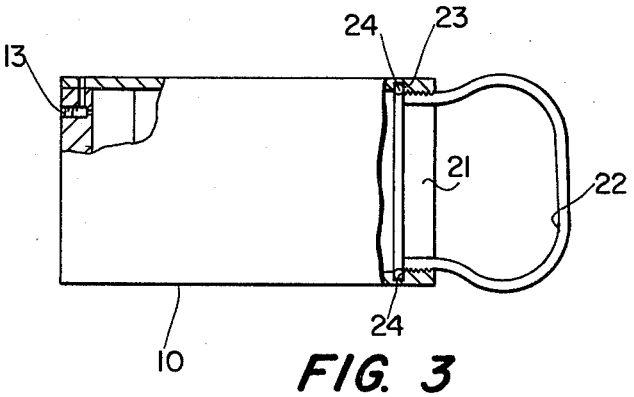
FIG. 3 is a side view of the container of this invention with the end cap or door screwed into locking position with the container.

The door 21 best illustrated in FIG. 3 is a cylindrical plate usually approximately one quarter to one half inch in thickness and fitted around its entire periphery with square or heavy buttress threads. These male threads on door 21 fit within and are screwed into female buttress square threads on the interior wall of cylinder 10. Handle 22, also best illustrated in FIG. 3 may be used to transport the entire container and is also utilized to screw the door 21 into position in container 10. It has been calculated, in connection with this invention, that the blasting exerts when detonated simultaneously a quasi-static pressure of one to four thousand PSI on the interior walls and door 21 of the container at a quasi-static pressure of approximately one to four thousand PSI. Therefore in the theoretical calculations all materials used in the construction of the container of this invention must withstand four thousand PSI static pressure. For example it has been found that the exterior walls of the cylindrical container were usually be advantageously made of stainless steel of a preferred thickness varying between one eighth inch and one half inch in thickness. A base wall that may be made of stainless steel or aluminum usually will be of a thickness in the range of one eighth inch to three quarters inch thick depending upon the material and its strength of material characteristics. In no event should a material be used that will not with stand one thousand PSI pressure. The screw on door member 21 best illustrated in FIG. 3 likewise may have a thickness in the range of one eighth to three quarters inch.

Figure 6:
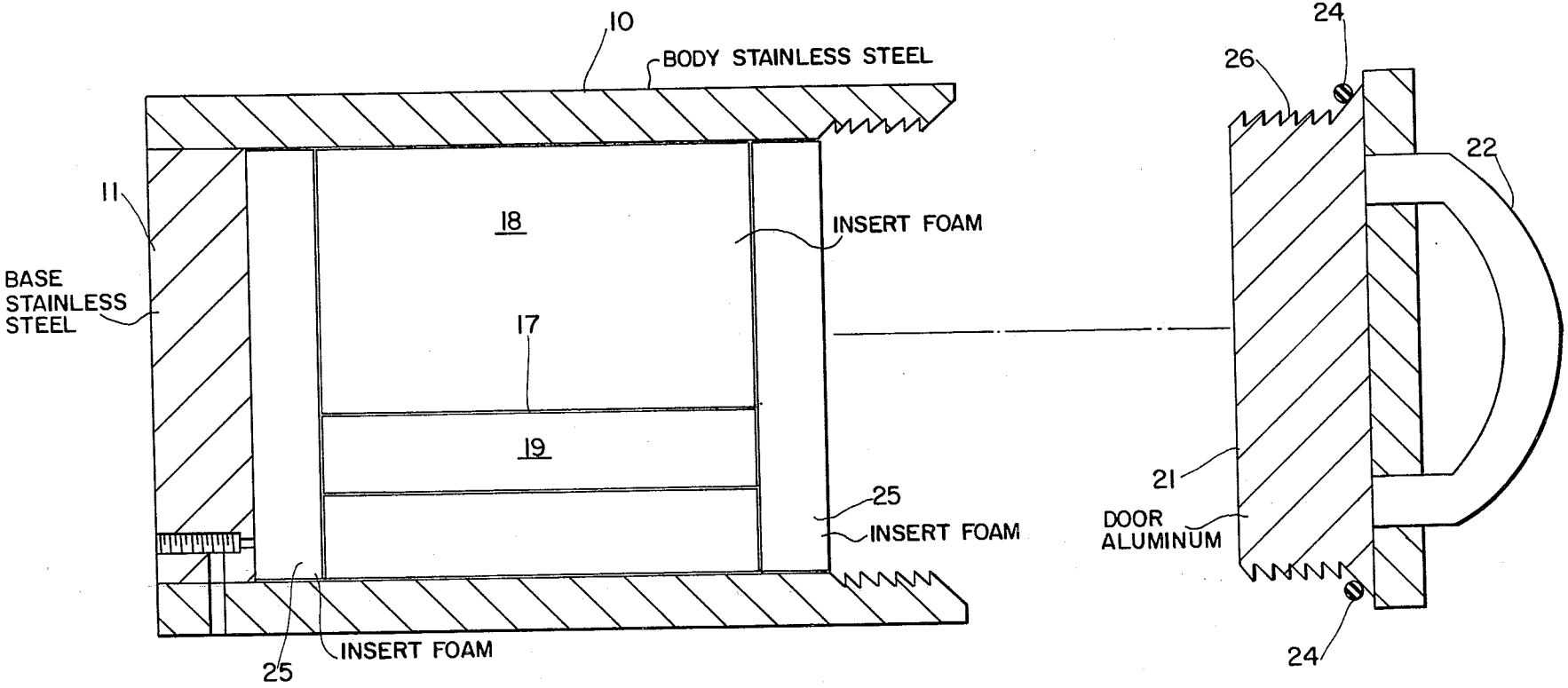
FIG. 6 is a cross-section view of the container and cap.

In FIG. 6 the O-ring 24 is fitted around the top of threaded area 26. Flat foam panels 25 are fitted at both ends of insert 18 and prevent the caps or cap containers from touching the base 11 or door 21. This illustrates a preference for any aluminum door 21 and stainless steel container 10, that are easier to assemble.

The various features and advantages of the invention are thought to be clear from the foregoing description of the drawings. However various other features and advantages not specifically enumerated may and will undoubtedly occur to those versed and skilled in the art of explosive containers, as likewise will many variations and modifications of the embodiments illustrated herein, all of which may be achieved without departing from the spirit and scope of the invention as defined by the appended claims.

What is claimed as new and desired to be secured by Letters Patent of the United States is:

1. An explosive shipping container particularly designed for the shipment and storage of blasting caps comprising: a cylindrical member having a secure base wall, said cylindrical member fitted with a removable door capable of being screwed into the cylindrical member; a shock absorbing means filling substantially the interior of said cylindrical member, said shock absorbing means fitted with a plurality of openings, each opening designed to fit in shock absorbing contact around one blasting cap, said door provided with exterior screw threads designed to fit within the interior upper wall of said cylindrical member, wherein the screw threads on said door are of the square buttress type that engage a buttress type thread located on the interior wall of the cylindrical member, the screw threaded joint between the door and the cylindrical member providing a fluid tight seal that is capable of withstanding high pressure.

2. The container of claim 1 further characterized wherein the door opening in the interior all of the said cylindrical member is fitted with square, buttress threads capable of withstanding a pressure of not less than one thousand PSI.

3. The container of claim 2 wherein the base wall of the container is fitted with a vent means to allow gases to escape.

4. The container of claim 1 further characterized and comprising a base wall member with a threaded vent opening therein and a hand screwed vent control member that allows flow of gases through said vent member.

5. The container of claim 1 further characterized in that a fitted shock absorbing insert member filling the entire opening within said container is provided and within said insert a plurality of openings each said opening accommodating one blasting cap is provided.

6. The insert member of claim 5 further characterized in that the shock absorbing material is selected from the group consisting of foam, plastic, soft wood and corrogated paper materials.

7. The invention of claim 5 wherein each of said openings in the insert are provided with an additional shock absorbing insert containing a non-electronic blasting cap.

8. The invention of claim 1 wherein all external parts and elements of the said container are made of reinforced plastic having a strength of materials quotient exceeding one thousand PSI.

9. The invention of claim 7 wherein the container is made of reinforced plastic is fitted with a shock absorbing foam insert formed in situ, said foam insert containing ten openings each opening accommodating and fitted in a tight shock absorbing contact around one blasting cap.

* * * * *